US008434649B2

(12) United States Patent
Gouverneur et al.

(10) Patent No.: US 8,434,649 B2
(45) Date of Patent: May 7, 2013

(54) PAINT CAN DISPENSER

(75) Inventors: Sebastien Gouverneur, Royal Oak, MI (US); Scott Boboltz, Okemos, MI (US)

(73) Assignee: Dedoes Industries, Inc., Walled Lake, MI (US)

( * ) Notice: Subject to any disclaimer, the term of this patent is extended or adjusted under 35 U.S.C. 154(b) by 582 days.

(21) Appl. No.: 12/685,122

(22) Filed: Jan. 11, 2010

(65) Prior Publication Data

US 2011/0168743 A1 Jul. 14, 2011

(51) Int. Cl.
*B67D 3/00* (2006.01)

(52) U.S. Cl.
USPC ..... 222/507; 222/499; 222/520; 222/525; 222/531

(58) Field of Classification Search ..... 222/505, 222/507, 519, 520, 521, 531
See application file for complete search history.

(56) References Cited

U.S. PATENT DOCUMENTS

| | | | | |
|---|---|---|---|---|
| 3,016,172 | A * | 1/1962 | Morrow et al. | 222/490 |
| 5,004,127 | A * | 4/1991 | Morel | 222/521 |
| 6,230,944 | B1 * | 5/2001 | Castellano et al. | 222/481.5 |
| 6,299,038 | B1 * | 10/2001 | Schmeisser et al. | 222/521 |
| 2004/0118873 | A1 * | 6/2004 | Foster et al. | 222/153.14 |

* cited by examiner

*Primary Examiner* — Kevin P Shaver
*Assistant Examiner* — Melvin Cartagena
(74) *Attorney, Agent, or Firm* — Gifford, Krass, Sprinkle, Anderson & Citkowski, P.C.

(57) ABSTRACT

A dispenser for a paint container having an access opening. The dispenser includes a main lid which is attachable to the paint can access opening and includes a threaded stem. A flow restrictor is threadably mounted to the threaded stem so that rotation of the flow restrictor relative to the stem axially displaces the flow restrictor along the stem. A turret is rotatably mounted to the main lid and includes a dispensing opening. The turret is mounted to the main lid so that the turret is locked against axial movement but freely rotatable relative to the main lid. The turret includes at least one axially extending slot which slidably receives an outwardly extending tab from the flow restrictor so that rotation of the turret axially displaces the flow restrictor along the stem.

11 Claims, 4 Drawing Sheets

PAINT CAN DISPENSER

BACKGROUND OF THE INVENTION

I. Field of the Invention

The present invention relates generally to dispensers and, more particularly, to a dispenser for a paint container.

II. Description of Related Art

Automotive repair facilities typically stock a plurality of different automotive paint colors to paint the automotive vehicles following completion of the automotive repair. In many cases, it is necessary to mix paints having different colors in order to obtain the final desired paint color. Furthermore, the actual measurement of the paint during such mixing is very important to properly match the paint to the existing paint on the vehicle.

Previously, automotive paints have been solvent based. However, due to governmental regulations in response to environmental concerns, automotive paints are rapidly moving towards water-based automotive paints. Previously, there have been no dispensers for such water-based automotive paints which achieve accurate measurement and dispensing of automotive paints when paint mixing is required.

SUMMARY OF THE PRESENT INVENTION

The present invention provides a dispenser for a paint container, and especially a paint container for water-based paints, which overcomes the above-mentioned disadvantages of the previously known dispensers.

In brief, the dispenser of the present invention includes a main lid which is attachable to an access opening on the paint container. Typically, the access opening on the paint container is externally threaded so that the main lid includes internal threads which threadably engage the threads on the paint container access opening. The main lid also includes an externally threaded stem which extends axially outwardly from the paint container access opening.

A flow restrictor includes an internally threaded bore which is threadably mounted on the threaded stem. Consequently, rotation of the flow restrictor relative to the stem axially displaces the flow restrictor relative to the stem. The flow restrictor also includes at least one outwardly extending tab.

A turret is rotatably mounted to the main lid but is locked against axial movement relative to the main lid. The turret includes a dispensing opening for the paint from the paint container.

The turret also includes an axially extending slot which slidably receives the flow restrictor tab. Consequently, rotation of the turret axially displaces the flow restrictor along the stem while the flow restrictor tabs axially slide in their cooperating slots in the turret.

The flow restrictor includes a surface which cooperates with an interior surface of the turret to variably restrict the dispensing opening formed between the flow restrictor surface and the interior surface of the turret as a function of the axial position of the flow restrictor. As such, the effective area of the dispensing opening, and the amount of paint dispensed through that dispensing opening, varies as a function of the position of the flow restrictor.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
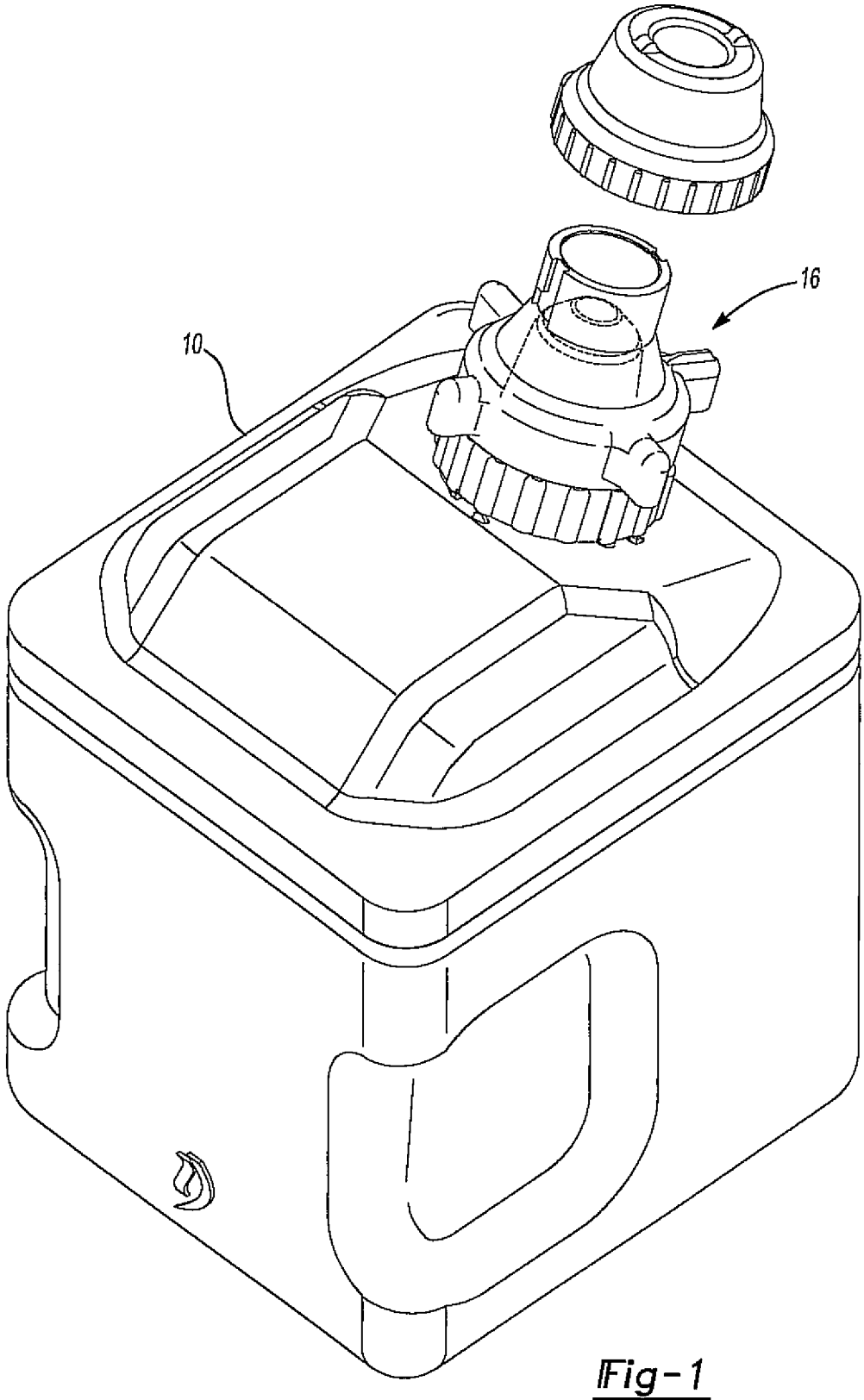
FIG. 1 is a partial exploded view illustrating a preferred embodiment of the dispenser of the present invention for use with a paint container.
Figure 2:
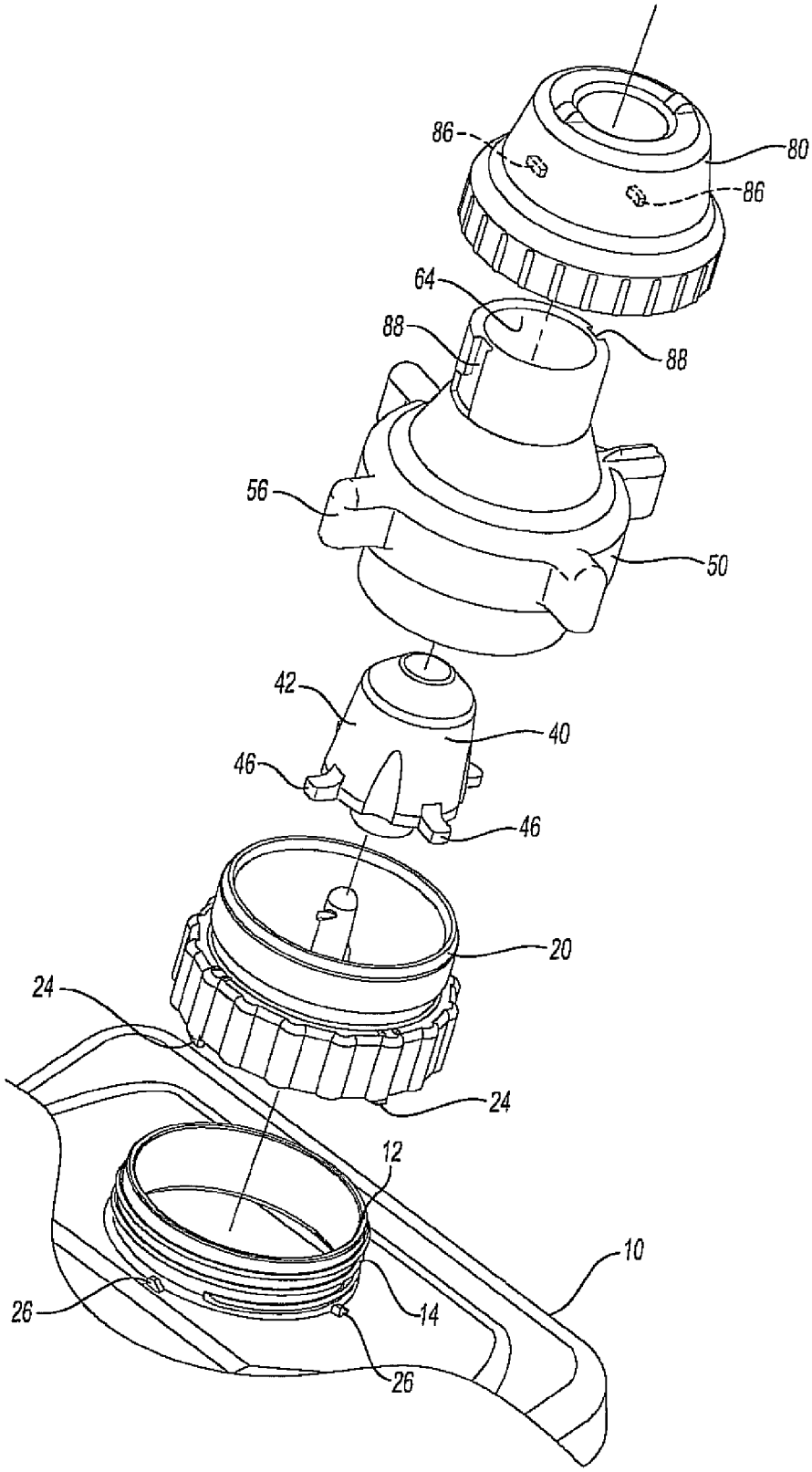
FIG. 2 is an exploded perspective view of the preferred embodiment of the dispenser.

With reference first to FIGS. 1 and 2, a paint container 10 is illustrated. The paint container 10 is generally rectangular in shape and of the type used to contain water-based automotive paints. The container 10 also includes an access opening 12 (FIG. 2) to provide access to the interior of the paint container 10. This access opening 12 is circular in shape and includes external threads 14. Furthermore, as best shown in FIG. 1, a dispenser 16 in accordance with the present invention is utilized to dispense paint from the container 10 through the access opening 12.

Figure 3:
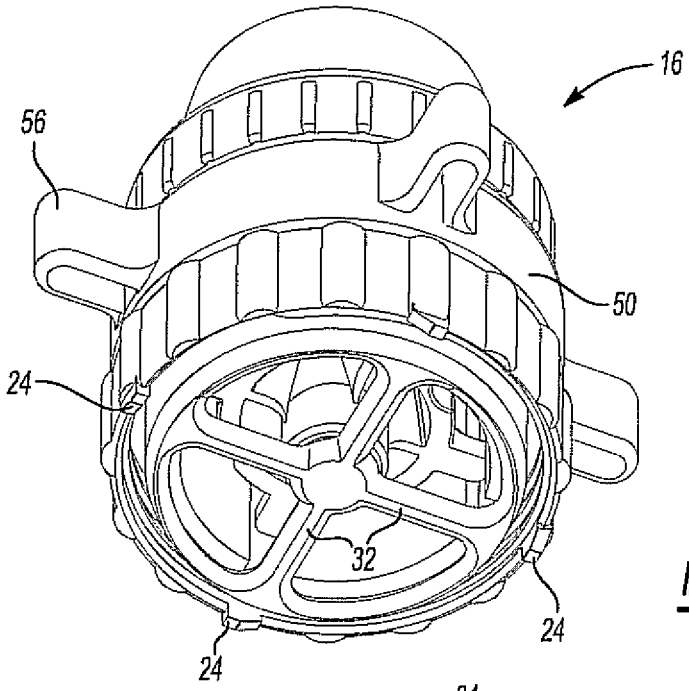
FIG. 3 is an elevational rear axial view illustrating the dispenser of the present invention.
Figure 4:
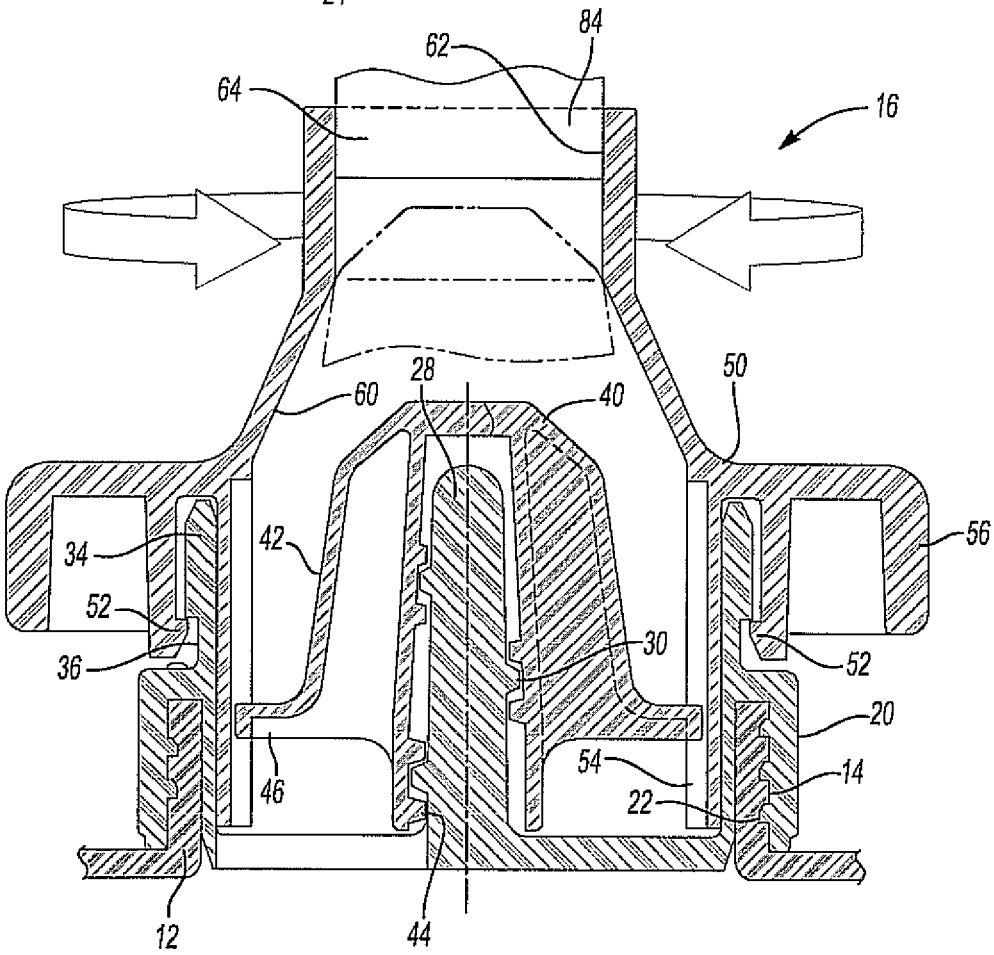
FIG. 4 is a longitudinal sectional view illustrating the dispenser of the present invention.

With reference now particularly to FIGS. 2-4, a main lid 20 includes an internally threaded portion 22, best shown in FIG. 4, which threadably cooperates with the external threads 14 of the paint container access opening 12. Consequently, in order to attach the main lid 20 to the paint can 10, the main lid 20 is merely screwed onto the access opening 12. In order to lock the main lid 20 against counter rotation once attached to the paint can 10, one or more locking retainers 24 (FIG. 2) snap lock against retaining tabs 26 on the paint container 10. The cooperation between the locking tabs 24 and retaining tabs 26 prevents counter rotation of the lid 20 after attachment to the paint container 10.

The main lid 20 further includes an axially extending stem 28 which is coaxial relative to the main lid 20. The stem 28 includes external threads 30 and is attached to the main lid 20 by a plurality of radially extending webs 32.

With reference now particularly to FIG. 4, the main lid 20 includes an axially extending annular collar 34 which extends outwardly from the paint container access opening 12. A circumferentially extending and outwardly facing groove 36 is formed in the collar 34 for a reason to be shortly described.

With reference now particularly to FIGS. 2 and 4, a flow restrictor 40 includes an internally threaded bore 44 (FIG. 4) which threadably engages the external threads 30 on the stem 28. Consequently, rotation of the flow restrictor 40 relative to the stem 28 axially displaces the flow restrictor 40 along the stem 28.

The flow restrictor 40 includes a generally conical outer surface 42. In addition, at least one, and preferably a plurality of circumferentially spaced tabs 46 extend radially outwardly from the flow restrictor 40 adjacent its base.

With reference now to FIGS. 2-4, a turret 50 includes at least one, and preferably several circumferentially spaced tangs 52 (FIG. 4) adjacent its base. The turret 50 is pushed onto and over the collar 34 on the main lid 20 until the tangs 52 snap into the outwardly facing groove 36 formed on the main lid 20. Consequently, the tangs 52 permit rotation of the turret 50 relative to the main lid 20, but also prevent axial movement of the turret 50 relative to the main lid 20.

As best shown in FIG. 4, the turret 50 includes an axially extending slot 54 for each tab 46 on the flow restrictor 40. The slots 54 are arranged so that one locking tab 46 is axially slidably mounted along its associated slot 54 while the interengagement of the slot 54 and the tabs 46 rotatably locks the turret 50 and flow restrictor 40 together.

Consequently, rotation of the turret 50 rotatably drives the flow restrictor 40 which, in turn, axially displaces the flow restrictor along the threaded stem 28. One or more handles 56 on the turret 50 facilitate rotation of the turret 50.

As best shown in FIG. 4, the turret 50 includes an inner tapered surface 60 which ends in a cylindrical surface 62 which forms a dispensing opening 64 for the dispenser 16. The tapered surface 60 of the turret 50 cooperates with the outer surface 60 of the flow restrictor 40 to vary the area of the effective opening between the flow restrictor 40 and the inner surface 60 of the turret 50 as a function of the axial position of the flow restrictor 40.

Figure 5:
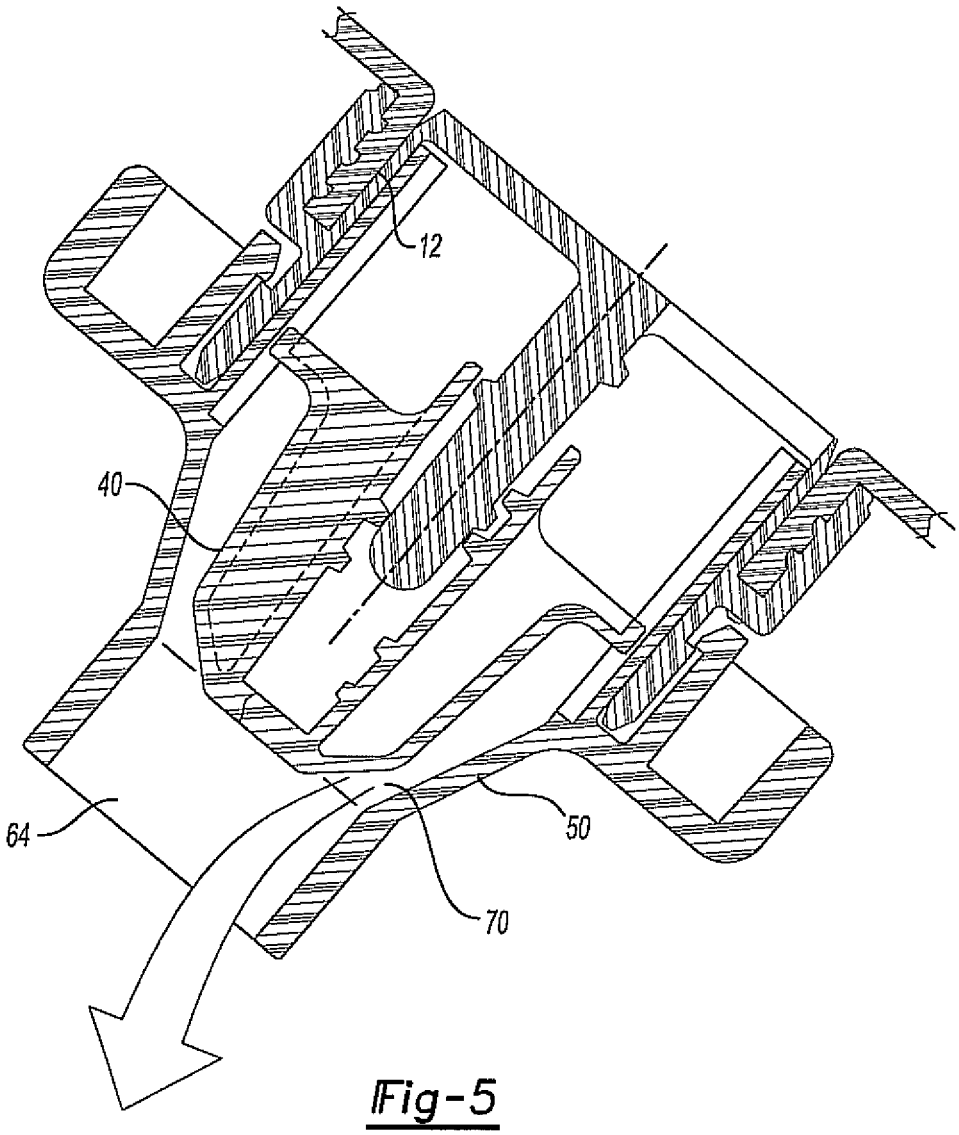
FIG. 5 is a view similar to FIG. 4, but illustrating the dispenser when used to dispense paint.

For example, as best shown in FIG. 5, the flow restrictor 40 and turret 50 form a generally annular opening 70 which fluidly connects the access opening 12 from the paint container to the dispensing opening 64. This annular opening 70 may be reduced in area by rotation of the turret 50 in a first direction, or conversely increased in area by rotation of the turret 50 in the opposite direction, to vary the flow rate of the paint out through the dispensing opening 64.

With reference now particularly to FIG. 2, a cap 80 is provided to close the dispensing opening 64 when dispensing of paint is not required. The cap 80 preferably includes a plug 84 (FIG. 4) which wipes the interior of the cylindrical surface 62 of the turret 50 as the cap 80 is pushed onto the turret 50. This plug 84 thus forces any paint in the cylindrical opening 62 of the turret 50 back into the paint container.

With reference again to FIG. 2, the cap 80 also preferably includes a pair of diametrically opposed bayonet pins 86. These bayonet pins 86 cooperate with bayonet slots 88 on the turret 50 to selectively lock the cap 80 onto the turret 50 when desired.

Preferably all of the components of the dispenser 16 are made of plastic. Such plastic construction is not only low cost, but unreactive to water-based paints.

From the foregoing, it can be seen that the present invention provides a dispenser for a paint container for water-based paints which enables accurate adjustment and mixing of paints as desired. Having described our invention, however, many modifications thereto will become apparent to those skilled in the art to which it pertains without deviation from the spirit of the invention as defined by the scope of the appended claims.

We claim:

1. A dispenser for a paint container having an access opening into an interior of the paint container, said dispenser comprising:

a main lid attachable to the paint container access opening, said main lid having a threaded stem, a flow restrictor threadably mounted on said threaded stem so that rotation of said flow restrictor relative to said stem axially displaces said flow restrictor relative to said stem, said flow restrictor having at least one outwardly extending tab, a turret rotatably mounted to said main lid and having a dispensing opening, said turret being locked against axial movement to said main lid, wherein said turret comprises an axially extending slot which slidably receives said flow restrictor tab so that rotation of said turret axially displaces said flow restrictor along said stem, wherein said flow restrictor includes a surface which cooperates with an interior surface of said turret to variably restrict said dispensing opening as a function of the axial position of said flow restrictor, and a cap removably attached to said turret which closes said dispensing opening.

2. The dispenser as defined in claim 1 wherein said turret includes bayonet slots around said dispensing opening and wherein said cap includes bayonet pins slidably positioned in said bayonet slots.

3. The dispenser as defined in claim 1 wherein said cap includes a plug which wipes said turret along said dispensing opening upon attachment of said cap to said turret to thereby force paint along said dispensing opening back into the paint container.

4. The dispenser as defined in claim 1 wherein said flow restrictor includes a plurality of circumferentially spaced tabs around said flow restrictor, each tab being positioned in an associated slot in said turret.

5. The dispenser as defined in claim 1 and comprising a locking tab on said main lid which cooperates with a cooperating retainer on the paint container to inhibit removal of said main lid from the paint container once attached.

6. The dispenser as defined in claim 1 wherein said main lid includes an outwardly facing circumferential groove and wherein said turret includes at least one tang which snaps into said groove to thereby lock said turret to said main lid against axial movement while allowing rotation of said turret relative to said main lid.

7. The dispenser as defined in claim 1 wherein said interior surface of said turret adjacent said dispensing opening is tapered and wherein said flow restrictor surface is generally conical in shape.

8. The dispenser as defined in claim 1 wherein said main lid, said turret and said flow restrictor are all made of plastic.

9. The dispenser as defined in claim 1 wherein said stem is attached to said main lid by a plurality of radially extending webs.

10. The dispenser as defined in claim 1 wherein said turret includes at least one radially outwardly extending handle.

11. The dispenser as defined in claim 10 wherein said turret includes a plurality of circumferentially spaced and radially outwardly extending handles.

* * * * *